US010960692B2

(12) United States Patent
Amari

(10) Patent No.: US 10,960,692 B2
(45) Date of Patent: Mar. 30, 2021

(54) LONG BODY PRINTER WITH MULTIPLE SOURCE AND TAKE-UP ROLLS AND A TENSION APPLYING MECHANISM

(71) Applicant: MIMAKI ENGINEERING CO., LTD., Nagano (JP)

(72) Inventor: Tomonori Amari, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/382,143

(22) Filed: Apr. 11, 2019

(65) Prior Publication Data

US 2019/0315136 A1 Oct. 17, 2019

(30) Foreign Application Priority Data

Apr. 12, 2018 (JP) ..... JP2018-076846

(51) Int. Cl.
*B41J 15/16* (2006.01)
*B41J 15/04* (2006.01)
*B65H 23/16* (2006.01)

(52) U.S. Cl.
CPC ..... *B41J 15/16* (2013.01); *B41J 15/04* (2013.01); *B41J 15/165* (2013.01); *B65H 23/16* (2013.01)

(58) Field of Classification Search
CPC . B41J 15/16; B41J 15/04; B41J 15/165; B41J 15/005; B41J 3/4078; B65H 23/16
See application file for complete search history.

(56) References Cited

U.S. PATENT DOCUMENTS 1,893,891 A 1/1933 Halliwell
8,708,476 B2 * 4/2014 Sasaki ..... B41J 15/16 347/101
9,102,136 B2 * 8/2015 Kambara ..... B41J 11/0085
9,308,748 B2 * 4/2016 Ishikawa ..... B41J 15/046
(Continued)

FOREIGN PATENT DOCUMENTS

JP 2013078953 5/2013
WO 9947354 9/1999

OTHER PUBLICATIONS

"Search Report of Europe Counterpart Application", dated Sep. 11, 2019, p. 1-p. 8.

(Continued)

*Primary Examiner* — John Zimmermann
(74) *Attorney, Agent, or Firm* — JCIPRNET

(57) ABSTRACT

A printer includes a printer main body that performs printing on a medium, a supporting frame that supports the printer main body from a lower side, a tension applying mechanism including a tension bar that comes into contact with a medium before printing and applies a tension to the medium, and a first roll attaching portion and a second roll attaching portion to which the medium before printing wound into a roll shape is attachable. The roll attaching portion, the tension bar, and the roll attaching portion are disposed on a back side of the supporting frame and are disposed in such order from a supporting frame side; and a medium after printing is wound into a roll shape on a front side of the supporting frame. The tension applying mechanism includes a frame having a guide groove for guiding the tension bar in a vertical direction.

8 Claims, 8 Drawing Sheets

(56) References Cited

U.S. PATENT DOCUMENTS

| | | | | |
|---|---|---|---|---|
| 2002/0113838 | A1* | 8/2002 | Nakajima | B41J 19/202 347/37 |
| 2004/0244621 | A1 | 12/2004 | Samii | |
| 2008/0128545 | A1* | 6/2008 | Midorikawa | B41J 11/06 242/596 |
| 2011/0242245 | A1* | 10/2011 | Okazaki | B65H 23/16 347/104 |
| 2015/0225196 | A1* | 8/2015 | Hamano | B65H 18/26 242/473.4 |
| 2016/0136980 | A1 | 5/2016 | Kobayashi et al. | |

OTHER PUBLICATIONS

Office Action of China Counterpart Application, with English translation thereof, dated Aug. 5, 2020, pp. 1-11.

* cited by examiner

LONG BODY PRINTER WITH MULTIPLE SOURCE AND TAKE-UP ROLLS AND A TENSION APPLYING MECHANISM

CROSS REFERENCE TO RELATED APPLICATIONS

This application claims the priority benefit of Japanese Patent Application No. 2018-076846, filed on Apr. 12, 2018. The entirety of the above-mentioned patent application is hereby incorporated by reference herein and made a part of this specification.

TECHNICAL FIELD

The present disclosure relates to a printer that performs printing on a long medium.

DESCRIPTION OF THE BACKGROUND ART

An inkjet printer that performs printing on a long medium (print medium) is conventionally known (e.g., see Japanese Unexamined Patent Publication No. 2013-78953). An inkjet printer described in Japanese Unexamined Patent Publication No. 2013-78953 is configured by a printer main body that performs printing on a medium, a supporting leg that supports the printer main body from a lower side, a feeding device that feeds out a medium before printing to the printer main body, and a winding device that winds a medium after printing. The feeding device is disposed on a back side of the supporting leg and the winding device is disposed on a front side of the supporting leg.

In the inkjet printer described in Japanese Unexamined Patent Publication No. 2013-78953, the feeding device includes a media feeding means that supports a tubular feeding shaft around which a medium before printing is wound and rotates the feeding shaft to feed out the medium, and a feeding side tension applying means that applies a tension to the medium fed out from the media feeding means. The winding device includes a media winding means that supports a tubular winding shaft around which a medium after printing is wound and rotates the winding shaft to wind the medium, and a winding side tension applying means that applies a tension to the medium wound by the media winding means.

In the inkjet printer described in Japanese Unexamined Patent Publication No. 2013-78953, the media feeding means includes a supporting shaft that is inserted to a feeding shaft to rotate integrally with the feeding shaft, and a shaft supporting portion that supports the supporting shaft. The media feeding means is disposed on a lower side of the printer main body. Furthermore, the media feeding means is disposed immediately on the back side of the supporting leg when viewed from a left-right direction. The feeding side tension applying means includes a tension bar that makes contact with a medium and a media arm that supports an end of the tension bar. The tension bar is rotatably attached to a distal end of the media arm. A feeding side rotating shaft is fixed to a basal end of the media arm, and the feeding side rotating shaft is rotatably supported by a rotating shaft supporting portion. That is, in the feeding side tension applying means, the media arm, to which the tension bar is attached at the distal end, is rotatable about the basal end of the media arm.

In the inkjet printer described in Japanese Unexamined Patent Publication No. 2013-78953, the media winding means includes a supporting shaft that is inserted to a winding shaft to rotate integrally with the winding shaft, and a shaft supporting portion that supports the supporting shaft. The media winding means is disposed on the lower side of the printer main body. Furthermore, the media winding means is disposed immediately on the front side of the supporting leg when viewed from the left-right direction. The winding side tension applying means includes a tension bar that makes contact with the medium and a media arm that supports an end of the tension bar. The tension bar is rotatably attached to a distal end of the media arm. A winding side rotating shaft is fixed to a basal end of the media arm, and the winding side rotating shaft is rotatably supported by a rotating shaft supporting portion. That is, in the winding side tension applying means, the media arm, to which the tension bar is attached at the distal end, is rotatable about the basal end of the media arm.

In the feeding side tension applying means of the inkjet printer described in Japanese Unexamined Patent Publication No. 2013-78953, the media arm, to which the tension bar is attached at a distal end, is turnable around a basal end of the media arm, and the tension applied to the medium by the tension bar easily changes according to a turning angle of the media arm because the tension bar turns around the basal end of the media arm. Therefore, in the present disclosure, when the feeding side tension applying means described in Japanese Unexamined Patent Publication No. 2013-78953 is adopted, it is difficult to apply an appropriate tension to the medium fed out from the first roll attached to the first roll attaching portion and the medium fed out from the second roll attached to the second roll attaching portion unless a turning center of the media arm is arranged at the optimum position.

On the other hand, in a case where the turning center of the media arm is arranged at an optimum position, a degree of freedom of arrangement of other members lowers. That is, in the present disclosure, when the feeding side tension applying means described in Japanese Unexamined Patent Publication No. 2013-78953 is adopted, a degree of freedom of design of the printer lowers to apply an appropriate tension to the medium fed out from the first roll attached to the first roll attaching portion and the medium fed out from the second roll attached to the second roll attaching portion.

In the winding side tension applying means of the inkjet printer described in Japanese Unexamined Patent Publication No. 2013-78953, the media arm, to which the tension bar is attached at the distal end, is turnable around the basal end of the media arm, and the tension applied to the medium by the tension bar easily changes according to the turning angle of the media arm because the tension bar turns around the basal end of the media arm. Therefore, in the present disclosure, when the winding side tension applying means described in Japanese Unexamined Patent Publication No. 2013-78953 is adopted, it is difficult to apply an appropriate tension to the medium wound around the first roll attached to the first roll attaching portion and the medium wound around the second roll attached to the second roll attaching portion unless the turning center of the media arm is arranged at the optimum position.

On the other hand, in a case where the turning center of the media arm is arranged at the optimum position, the degree of freedom of arrangement of other members lowers. That is, in the present disclosure, when the winding side tension applying means described in Japanese Unexamined Patent Publication No. 2013-78953 is adopted, the degree of freedom of design of the printer lowers to apply an appropriate tension to the medium wound around the first roll attached to the first roll attaching portion and the medium wound around the second roll attached to the second roll attaching portion.

SUMMARY

In the inkjet printer described in Japanese Unexamined Patent Publication No. 2013-78953, the media feeding means is disposed immediately on the back side of the supporting leg when viewed from the left-right direction, and the media winding means is disposed immediately on the front side of the supporting leg. Therefore, in this inkjet printer, a maximum outer diameter of a roll-shaped medium before printing wound around the feeding shaft needs to be set so as not to interfere with a roll-shaped medium after printing wound around the winding shaft, and the maximum outer diameter of the medium before printing wound into a roll shape may be restricted by an outer diameter of the medium after printing wound into a roll shape. Therefore, in the inkjet printer described in Japanese Unexamined Patent Publication No. 2013-78953, a user usability may degrade.

Similarly, in the inkjet printer described in Japanese Unexamined Patent Publication No. 2013-78953, a maximum outer diameter of a roll-shaped medium after printing wound around the winding shaft needs to be set so as not to interfere with a rolled-shaped medium before printing wound around the feeding shaft, and the maximum outer diameter of the medium after printing wound into a roll shape may be restricted by an outer diameter of the medium before printing wound into a roll shape. Therefore, in the inkjet printer described in Japanese Unexamined Patent Publication No. 2013-78953, the user usability may degrade.

It is therefore an object of the present disclosure to provide a printer that performs printing on a long medium, capable of setting a maximum outer diameter of a medium before printing wound into a roll shape without being subjected to a restriction of an outer diameter of the medium after printing wound into a roll shape. It is another object of the present disclosure to provide a printer that performs printing on a long medium, capable of setting a maximum outer diameter of a medium after printing wound into a roll shape without being subjected to a restriction of an outer diameter of the medium before printing wound into a roll shape.

In order to solve the above problems, the printer of the present disclosure includes a printer main body that performs printing on a long medium, a supporting frame that supports the printer main body from a lower side, a tension applying mechanism including a tension bar that comes into contact with the medium before printing and applies a tension to the medium, and a first roll attaching portion and a second roll attaching portion to which the medium before printing wound into a roll shape is attachable, where the first roll attaching portion, the tension bar, and the second roll attaching portion are disposed on one side of the supporting frame in a first direction, which is one direction in a horizontal direction, and are disposed in such order from a supporting frame side in the first direction; the medium after printing is wound into a roll shape on another side of the supporting frame in the first direction; assuming that the medium before printing wound into a roll shape and attached to the first roll attaching portion is a first roll and the medium before printing wound into a roll shape and attached to the second roll attaching portion is a second roll, a maximum outer diameter of the second roll is larger than a maximum outer diameter of the first roll; and the tension applying mechanism includes a frame in which a guide groove having a slit shape for guiding the tension bar in a vertical direction.

The printer according to the present disclosure includes a tension applying mechanism including a tension bar that comes into contact with a medium before printing and applies a tension on the medium, and a first roll attaching portion and a second roll attaching portion to which the medium before printing wound into a roll shape can be attached. Furthermore, in the present disclosure, the first roll attaching portion, the tension bar, and the second roll attaching portion are disposed on one side of the supporting frame in the first direction, which is one direction in the horizontal direction, and are disposed in such order from the supporting frame side in the first direction, and the second roll attaching portion is disposed at a position away from the supporting frame.

Therefore, in the present disclosure, a distance between the medium after printing wound into a roll shape on the other side of the supporting frame in the first direction and the medium before printing wound into a roll shape and attached to the second roll attaching portion can be separated. Therefore, in the present disclosure, the maximum outer diameter of the medium before printing wound into a roll shape and attached to the second roll attaching portion can be set without being subjected to the restriction of the outer diameter of the medium after printing wound into a roll shape.

In the present disclosure, the tension applying mechanism includes a frame in which the guide groove having a slit shape for guiding the tension bar in the vertical direction, and the tension bar moves in the vertical direction along the guide groove, whereby the tension applied to the medium by the tension bar is unlikely to change according to the vertical position of the tension bar. Therefore, in the present disclosure, even if the guide grooves are disposed so that a degree of freedom of arrangement of other members does not lower, an appropriate tension can be applied to the medium fed out from the first roll attached to the first roll attaching portion and the medium fed out from the second roll attached to the second roll attaching portion. That is, in the present disclosure, even if an appropriate tension can be applied to the medium fed out from the first roll attached to the first roll attaching portion and the medium fed out from the second roll attached to the second roll attaching portion, a degree of freedom of design of the printer can be ensured.

In order to solve the above problem, a printer of the present disclosure includes a printer main body that performs printing on a long medium, a supporting frame that supports the printer main body from a lower side, a tension applying mechanism including a tension bar that comes into contact with the medium after printing and applies a tension to the medium, and a first roll attaching portion and a second roll attaching portion to which the medium after printing wound into a roll shape is attachable, where the first roll attaching portion, the tension bar, and the second roll attaching portion are disposed on one side of the supporting frame in a first direction, which is one direction in a horizontal direction, and are disposed in such order from the supporting frame side in the first direction; the medium before printing is wound into a roll shape on the other side of the supporting frame in the first direction; assuming that the medium after printing wound into a roll shape and attached to the first roll attaching portion is a first roll and the medium after printing wound into a roll shape and attached to the second roll attaching portion is a second roll, a maximum outer diameter of the second roll is larger than a maximum outer diameter of the first roll; and the tension applying mechanism includes a frame in which a guide groove having a slit shape for guiding the tension bar in a vertical direction is formed.

The printer according to the present disclosure includes a tension applying mechanism including a tension bar that comes into contact with a medium after printing and applies a tension on the medium, and a first roll attaching portion and a second roll attaching portion to which the medium after printing wound into a roll shape can be attached. Furthermore, in the present disclosure, the first roll attaching portion, the tension bar, and the second roll attaching portion are disposed on one side of the supporting frame in the first direction, which is one direction in the horizontal direction, and are disposed in such order from the supporting frame side in the first direction, and the second roll attaching portion is disposed at a position away from the supporting frame.

Therefore, in the present disclosure, a distance between the medium before printing wound into a roll shape on the other side of the supporting frame in the first direction and the medium after printing wound into a roll shape and attached to the second roll attaching portion can be separated. Therefore, in the present disclosure, the maximum outer diameter of the medium after printing wound into a roll shape and attached to the second roll attaching portion can be set without being subjected to the restriction of the outer diameter of the medium before printing wound into a roll shape.

On the other hand, in the present disclosure, the tension applying mechanism includes a frame in which the guide groove having a slit shape for guiding the tension bar in the vertical direction, and the tension bar moves in the vertical direction along the guide groove, whereby the tension applied to the medium by the tension bar is unlikely to change according to the vertical position of the tension bar. Therefore, in the present disclosure, even if the guide groove is disposed so that the degree of freedom of arrangement of other members does not lower, an appropriate tension can be applied to the medium wound around the first roll attached to the first roll attaching portion and the medium wound around the second roll attached to the second roll attaching portion. That is, in the present disclosure, even if an appropriate tension can be applied to the medium wound around the first roll attached to the first roll attaching portion and the medium wound around the second roll attached to the second roll attaching portion, the degree of freedom of design of the printer can be ensured.

In the present disclosure, for example, the guide groove is inclined so as to approach the supporting frame towards a lower side.

In the present disclosure, the printer preferably includes a supporting body having a supporting member, to which the lower end of the supporting frame is fixed, and the frame is preferably detachably attached to the supporting body. With such a configuration, for example, the tension applying mechanism can be easily detached from the supporting body when the printer does not use the tension applying mechanism.

As described above, according to the present disclosure, in a printer that performs printing on a long medium, the maximum outer diameter of the medium before printing wound into a roll shape can be set without being subjected to the restriction of the outer diameter of the medium after printing wound into a roll shape. Furthermore, in the present disclosure, in a printer that performs printing on a long medium, the maximum outer diameter of the medium after printing wound into a roll shape can be set without being subjected to the restriction of the outer diameter of the medium before printing wound into a roll shape.

DETAILED DESCRIPTION OF EMBODIMENT

Hereinafter, an embodiment of the present disclosure will be described with reference to the accompanying drawings.

(Configuration of Printer)

Figure 1:
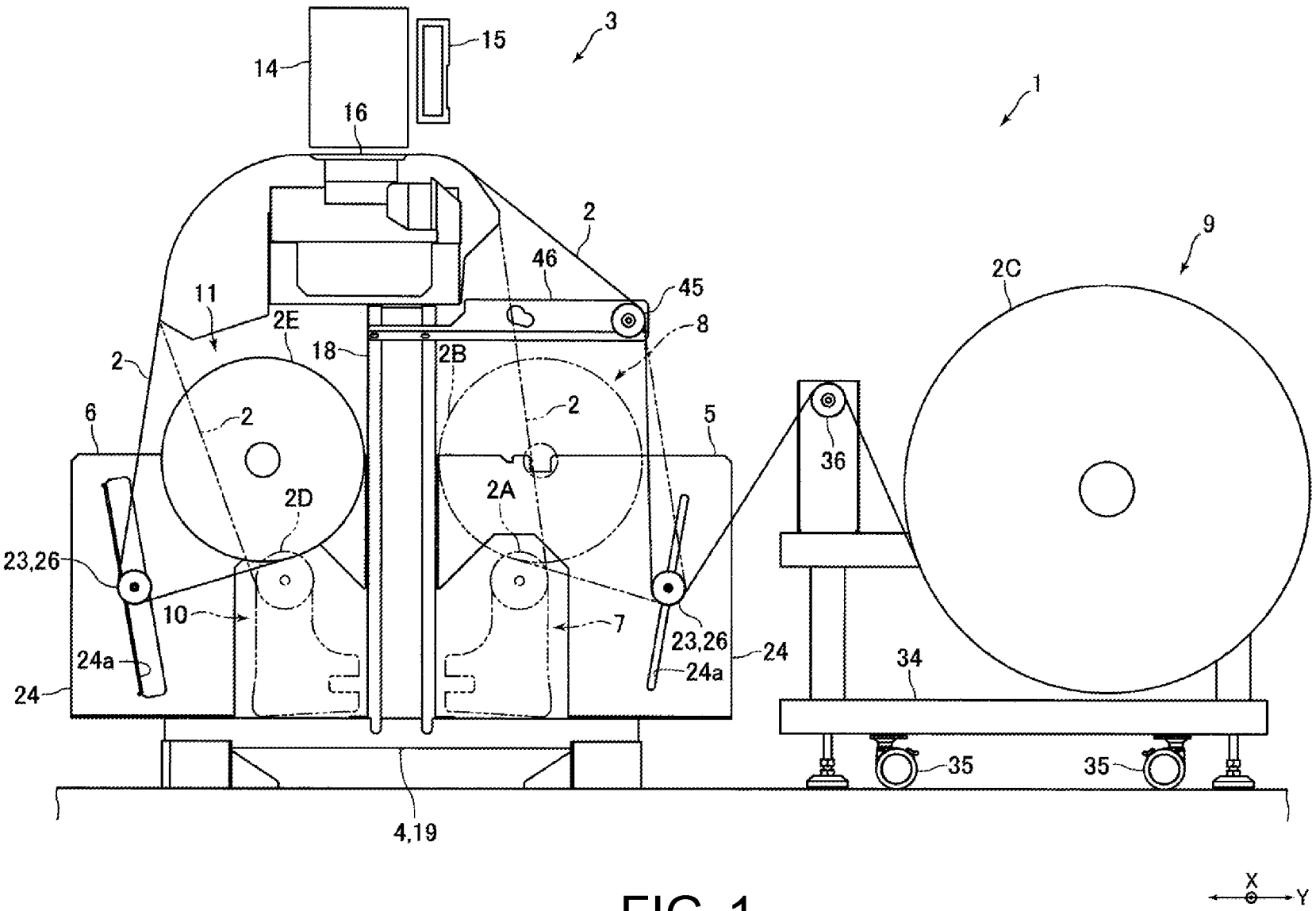
FIG. 1 is a side view for explaining a configuration of a printer according to an embodiment of the present disclosure.
Figure 2:
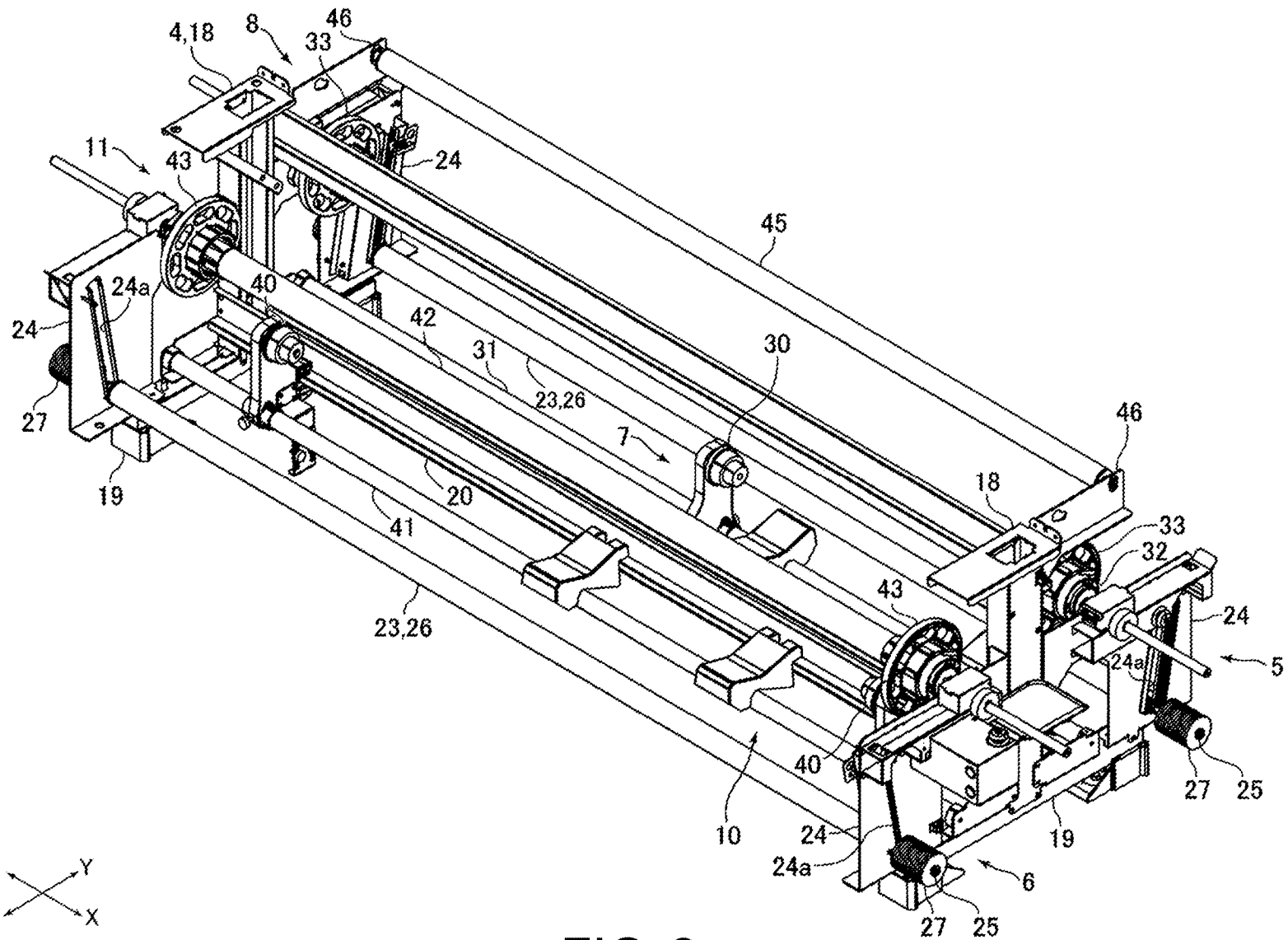
FIG. 2 is a perspective view of a supporting body, roll attaching portions, tension applying mechanisms, and the like shown in FIG. 1.
Figure 3:
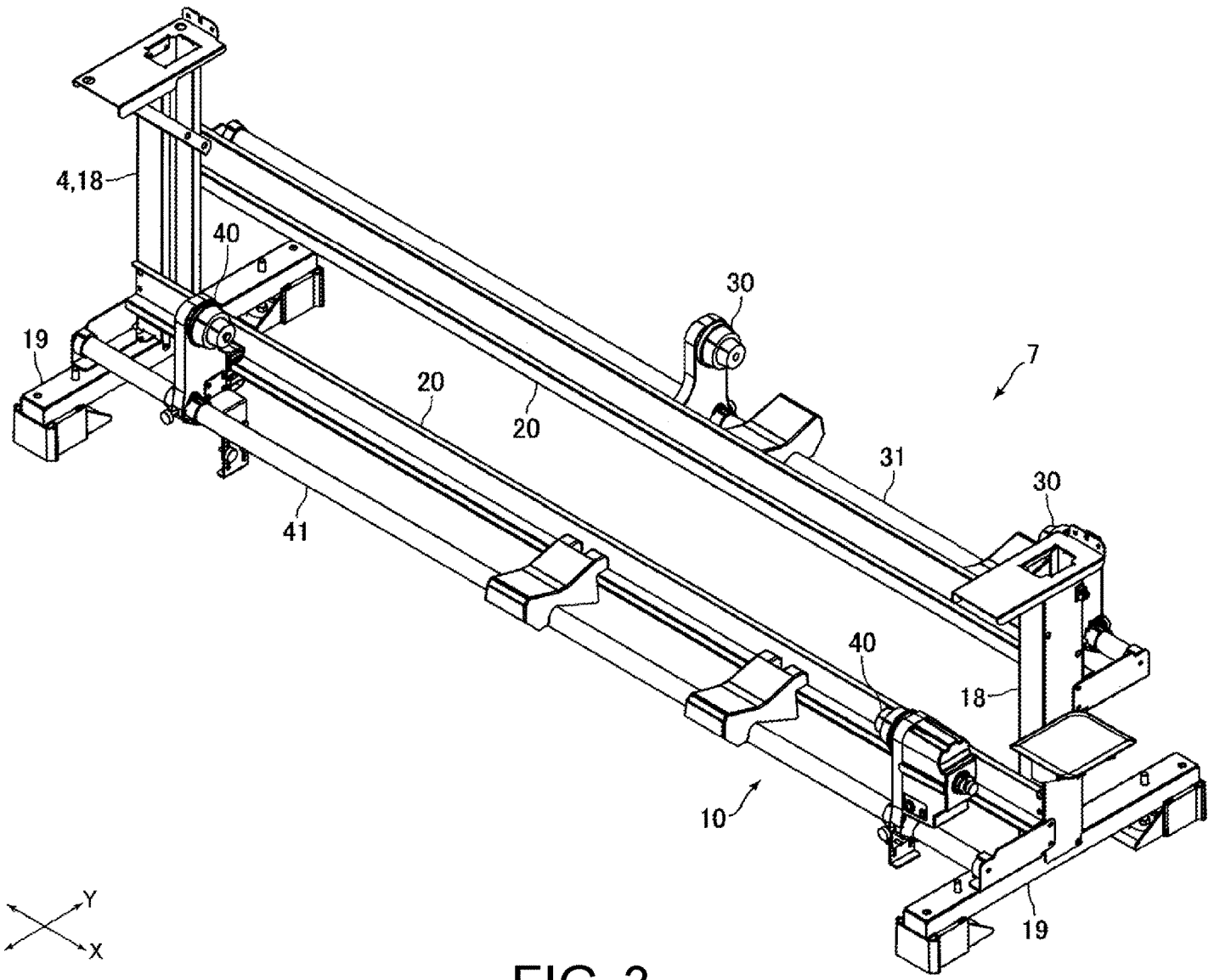
FIG. 3 is a perspective view of the supporting body and the roll attaching portions shown in FIG. 1.

FIG. 1 is a side view for explaining a configuration of a printer 1 according to an embodiment of the present disclosure. FIG. 2 is a perspective view of a supporting body 4, roll attaching portions 7, 8, 10, and 11, and tension applying mechanisms 5, and 6, and the like shown in FIG. 1. FIG. 3 is a perspective view of the supporting body 4 and the roll attaching portions 7, and 10 shown in FIG. 1.

The printer 1 of the present embodiment is an inkjet printer for business use. The printer 1 includes a printer main body 3 that performs printing on a long medium 2 (sheet-like medium 2) such as paper, fabric, or a resin sheet, the supporting body 4 that supports the printer main body 3 from a lower side, the tension applying mechanism 5 that comes into contact with a medium 2 before printing to apply tension to the medium 2, and the tension applying mechanism 6 that comes into contact with a medium 2 after printing to apply tension to the medium 2. Furthermore, the printer 1 includes the roll attaching portions 7, 8, and 9 to which the medium 2 before printing wound into a roll shape can be attached, and the roll attaching portions 10, and 11 to which the medium 2 after printing wound into a roll shape can be attached.

The printer 1 of the present embodiment includes three roll attaching portions 7 to 9 to which the medium 2 before printing wound into a roll shape can be attached, and two roll attaching portions 10, and 11 to which the medium 2 after printing wound into a roll shape can be attached. In the printer 1, the medium 2 before printing is attached to one of the roll attaching portions 7 to 9, and the medium 2 after printing is wound in the roll attaching portion 10 or the roll attaching portion 11 (see FIGS. 4 to 8).

Assuming that the medium 2 before printing wound into a roll shape and attached to the roll attaching portion 7 is a roll 2A, the medium 2 before printing wound into a roll shape and attached to the roll attaching portion 8 is a roll 2B, and the medium 2 before printing wound into a roll shape and attached to the roll attaching portion 9 is a roll 2C, a maximum outer diameter of the roll 2C is larger than a maximum outer diameter of the roll 2B, and the maximum outer diameter of the roll 2B is larger than a maximum outer diameter of the roll 2A.

That is, the outer diameter of a new roll 2C set in the roll attaching portion 9 is larger than the outer diameter of a new roll 2B set in the roll attaching portion 8, and the outer diameter of the new roll 2B set in the roll attaching portion 8 is larger than the outer diameter of the new roll 2A set in the roll attaching portion 7. The maximum outer diameter of the roll 2C is, for example, about 500 (mm) to 600 (mm). Furthermore, for example, the maximum outer diameter of the roll 2B is about half the maximum outer diameter of the roll 2C, and the maximum outer diameter of the roll 2A is about one third of the maximum outer diameter of the roll 2B. The roll attaching portion 8 of the present embodiment is a first roll attaching portion and the roll attaching portion 9 is a second roll attaching portion. Furthermore, the roll 2B of the present embodiment is a first roll and the roll 2C is a second roll.

Furthermore, assuming that the medium 2 after printing wound into a roll shape and attached to the roll attaching portion 10 is a roll 2D, and the medium 2 after printing wound into a roll shape and attached to the roll attaching portion 11 is a roll 2E, a maximum outer diameter of the roll 2E is larger than a maximum outer diameter of the roll 2D. That is, the maximum outer diameter of the roll 2E that can be wound in the roll attaching portion 11 after printing is larger than the maximum outer diameter of the roll 2D that can be wound in the roll attaching portion 10 after printing. For example, the maximum outer diameter of the roll 2E is equal to the maximum outer diameter of the roll 2B, and the maximum outer diameter of the roll 2D is equal to the maximum outer diameter of the roll 2A.

The printer main body 3 includes a carriage 14 on which an inkjet head that ejects ink droplets toward the medium 2 is mounted, a carriage driving mechanism (not shown) that moves the carriage 14 in a main scanning direction (X direction in FIG. 1 etc.), and a supporting frame 15 that supports the carriage 14 so as to be movable in the main scanning direction. The inkjet head ejects ink droplets toward the lower side. A platen 16 is disposed on a lower side of the carriage 14. A medium 2 at a time of printing is placed on the platen 16.

Furthermore, the printer main body 3 includes a medium transporting mechanism (not shown) that transports the medium 2 placed on the platen 16 in a sub-scanning direction (Y direction in FIG. 1 etc.) orthogonal to a vertical direction and the main scanning direction. In the following description, the main scanning direction (X direction) is assumed as "left-right direction" and the sub-scanning direction (Y direction) is assumed as "front-back direction". The medium 2 before printing is transported from a back side to an upper surface of the platen 16, and the medium 2 after printing is transported from the upper surface of the platen 16 to a front side. The front-back direction (Y direction) of the present embodiment is a first direction, which is one direction in a horizontal direction.

The supporting body 4 includes a supporting frame 18 that supports the printer main body 3 from the lower side and has a columnar shape, and a supporting member 19 to which a lower end of the supporting frame 18 is fixed. The printer main body 3 is fixed to an upper end of the supporting frame 18. The supporting member 19 is formed so as to extend from the lower end of the supporting frame 18 to both sides in the front-back direction. The supporting frame 18 supports two places, a right end of the printer main body 3 and a left end of the printer main body 3, from the lower side. That is, the supporting body 4 includes two supporting frames 18 and two supporting members 19 disposed on both left and right end sides.

Furthermore, the supporting body 4 includes two connecting frames 20 that connect the two supporting frames 18. As shown in FIG. 3, one of the two connecting frames 20 is fixed to front surfaces of the two supporting frames 18, and the other connecting frame 20 is fixed to back surfaces of the two supporting frames 18, as shown in FIG. 3. In FIG. 1, and FIGS. 4 to 8, illustration of the connecting frames 20 is omitted.

The tension applying mechanism 5 is disposed on a back side of the supporting frame 18. Furthermore, the tension applying mechanism 5 is disposed on a lower side of the printer main body 3. The tension applying mechanism 5 includes a tension bar 23 that comes into contact with the medium 2 before printing and applies a tension to the medium 2, and two frames 24 each having a slit-shaped guide groove 24*a* for guiding the tension bar 23 in the vertical direction.

The tension bar 23 is configured by an inner bar 25 formed into an elongated circular columnar shape and an outer bar 26 formed into an elongate cylindrical shape through which the inner bar 25 is inserted to an inner peripheral side. The tension bar 23 is disposed so that an axial direction (longitudinal direction) of the inner bar 25 and the outer bar 26 coincides with the left-right direction. That is, the tension bar 23 is disposed so that the axial direction of the tension bar 23 coincides with the left-right direction. The tension bar 23 is disposed such that the axial direction of the tension bar 23 is orthogonal to a transporting direction of the medium 2.

The two frames 24 are fixed to the supporting body 4. Specifically, one of the two frames 24 is fixed to the supporting frame 18 and the supporting member 19 disposed on the right end side, and the other frame 24 is fixed to the supporting frame 18 and the supporting member 19 disposed on the left end side. Furthermore, the frames 24 are fixed to the supporting frames 18 and the supporting members 19 by screws, so that the frames 24 are detachable with respect to the supporting frames 18 and the supporting members 19. That is, the frames 24 are detachably attached to the supporting body 4. More specifically, the frames 24 are detachably attached to the supporting body 4 by screws. A screw hole, to which a screw for fixing the frame 24 is screwed in, is formed on a back surface of each of the supporting frames 18. A screw hole, to which a screw for fixing the frame 24 is screwed in, is also formed on an upper surface of each of the supporting members 19.

One end side portion of the inner bar 25 is inserted to the guide groove 24*a* of one of the two frames 24 and another end side portion of the inner bar 25 is inserted to the guide groove 24*a* of the other frame 24. Each of the guide groove 24*a* is inclined so as to be directed toward the front side as it goes towards the lower side. That is, each of the guide grooves 24*a* is inclined so as to approach the supporting frame 18 as it goes towards the lower side. The outer bar 26 is disposed between the two frames 24. The outer bar 26 is rotatable relative to the inner bar 25 with the left-right direction as the axial direction of rotation. The outer bar 26 is brought into contact with the medium 2. It should be noted that the tension bar 23 may have an integral structure in which a portion corresponding to the inner bar 25 and a portion corresponding to the outer bar 26 are integrated.

As shown in FIG. 2, weights 27 are attached to both ends of the inner bar 25. The weights 27 are disposed on the outer side of the two frames 24 in the left-right direction. Pinions are fixed to both ends of the inner bar 25. The pinions are disposed on the inner side of the two frames 24 in the left-right direction. The pinions each mesh with a rack fixed to the frame 24. The rack is fixed to the frame 24 along the guide groove 24*a*. Ball bearings disposed in the guide grooves 24*a* are attached to both ends of the inner bar 25. The tension bar 23 moves in the vertical direction along the guide grooves 24*a*.

The tension applying mechanism 6 is disposed on a front side of the supporting frames 18. Furthermore, the tension applying mechanism 6 is disposed on the lower side of the printer main body 3. The tension applying mechanism 6 is configured similarly to the tension applying mechanism 5, and includes a tension bar 23 that comes into contact with the medium 2 after printing and applies tension to the medium 2, and two frames 24 each having a guide groove 24*a* for guiding the tension bar 23 in the vertical direction. The tension applying mechanism 5 and the tension applying mechanism 6 are arranged line-symmetrically with a center line of the supporting frame 18 in the left-right direction as an axis of symmetry when viewed from the left-right direction. Therefore, in the tension applying mechanism 6, each of the guide grooves 24*a* is inclined so as to be directed toward the back side as it goes towards the lower side. That is, each of the guide grooves 24*a* is inclined so as to approach the supporting frame 18 as it goes towards the lower side in the tension applying mechanism 6 as well.

Since the tension applying mechanism 6 is configured similarly to the tension applying mechanism 5, the description on the specific configuration of the tension applying mechanism 6 will be omitted. A screw hole, into which a screw for fixing the frame 24 of the tension applying mechanism 6 is screwed, is formed on the front surface of each of the supporting frames 18. A screw hole, into which a screw for fixing the frame 24 of the tension applying mechanism 6 is screwed, is also formed on the upper surface of each of the supporting members 19.

The roll attaching portions 7 to 9 are disposed on the back side of the supporting frame 18. That is, the medium 2 before printing is wound into a roll shape on the back side of the supporting frame 18. The roll attaching portion 7 includes two shaft supporting portions 30 that support both ends of an elongate cylindrical winding shaft around which the roll 2A is wound. The shaft supporting portions 30 are held by a guide shaft 31 so as to be movable in the front-back direction. The shaft supporting portions 30 each are movable in the front-back direction along the guide shaft 31. Furthermore, the shaft supporting portions 30 each are connected to a drive mechanism that rotates the shaft supporting portion 30.

The roll attaching portion 8 includes a rotating shaft 32 inserted to an elongate cylindrical winding shaft around which the roll 2B is wound (see FIG. 2). The rotating shaft 32 is disposed so that an axial direction of the rotating shaft 32 and the left-right direction coincide. A right end of the rotating shaft 32 is rotatably supported by the frame 24 disposed on the right end side of the tension applying mechanism 5, and the left end of the rotating shaft 32 is rotatably supported by the frame 24 disposed on a left end side of the tension applying mechanism 5. Flange members 33 disposed on both sides of the roll 2B in the left-right direction are fixed to both ends of the rotating shaft 32. The rotating shaft 32 is connected to a drive mechanism that rotates the rotating shaft 32.

The roll attaching portion 9 includes a rotating shaft inserted to an elongate cylindrical winding shaft around which the roll 2C is wound. The rotating shaft is disposed so that the axial direction of the rotating shaft and the left-right direction coincide. Both ends of the rotating shaft are rotatably supported by a supporting frame 34 disposed on a back side of the supporting body 4. Furthermore, the rotating shaft is connected to a drive mechanism that rotates the rotating shaft. A wheel 35 is attached to the lower end of the supporting frame 34. Therefore, the roll attaching portion 9 and the supporting frame 34 can be easily moved. A guide roller 36 for guiding the medium 2 is attached to an upper end side of a front end of the supporting frame 34. The guide roller 36 is disposed on a front side of the roll attaching portion 9.

As described above, the roll attaching portion 8, the tension bar 23 of the tension applying mechanism 5, and the roll attaching portion 9 are disposed on the back side of the supporting frames 18. Furthermore, the roll attaching portion 8, the tension bar 23 of the tension applying mechanism 5, and the roll attaching portion 9 are disposed in this order from the front side to the back side. That is, the roll attaching portion 8, the tension bar 23 of the tension applying mechanism 5, and the roll attaching portion 9 are disposed in this order from the supporting frame 18 side in the front-back direction, the roll attaching portion 8 is disposed on the supporting frame 18 side of the tension bar 23 of the tension applying mechanism 5 and the roll attaching portion 9 is disposed at a position farther away from the supporting frames 18 than the tension bar 23 of the tension applying mechanism 5. Moreover, the roll attaching portion 9 is disposed on a back side with respect to the printer main body 3 and the supporting members 19.

Figure 8:
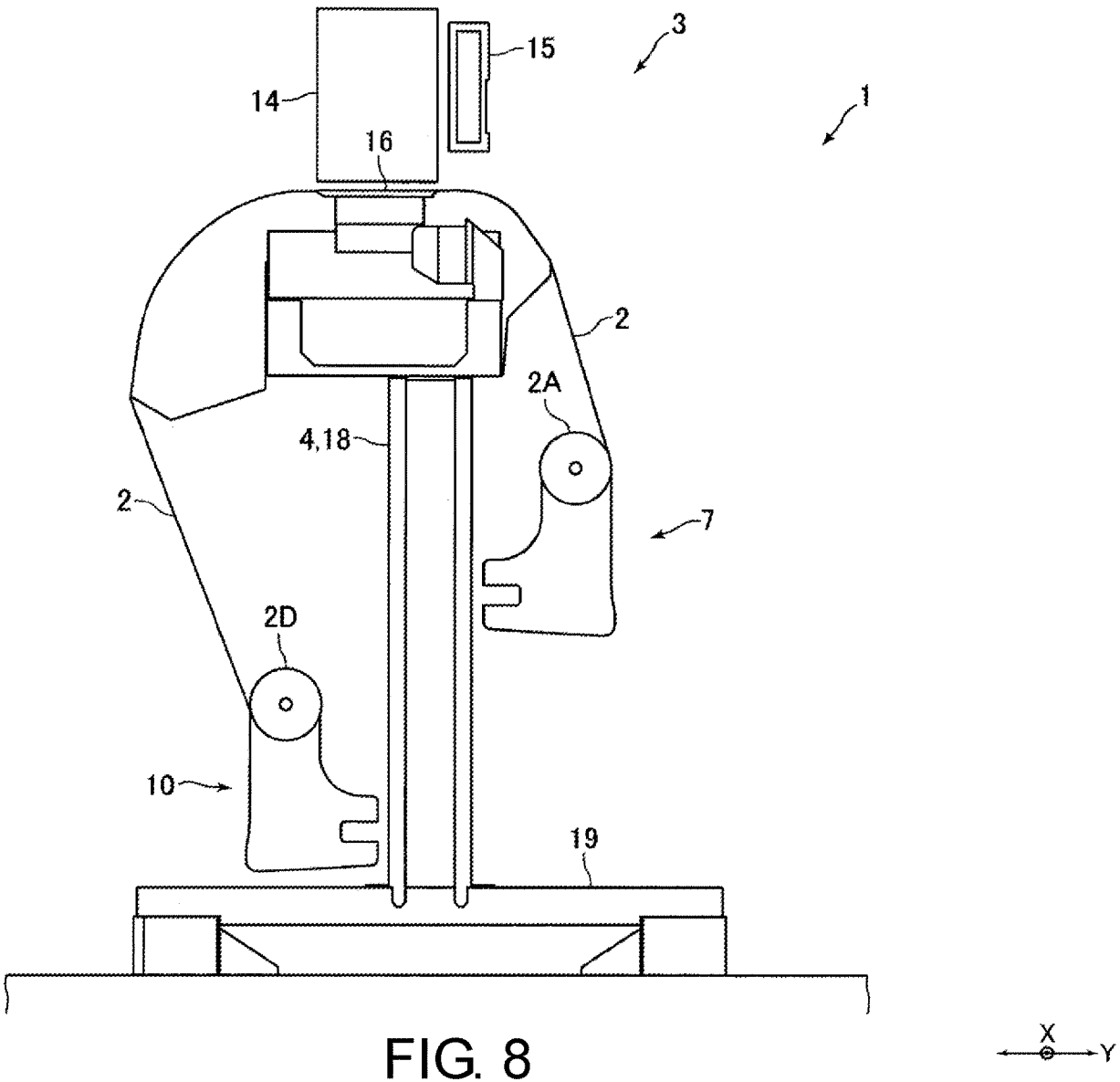
FIG. 8 is a side view for explaining a usage mode of the printer shown in FIG. 1.

The roll attaching portion 7 is disposed on a lower side of the roll attaching portion 8. Furthermore, the roll attaching portion 7 is disposed on a front side of the tension bar 23 of the tension applying mechanism 5. When the medium 2 before printing is attached to the roll attaching portion 7 (see FIG. 8), the tension applying mechanism 5 and the roll attaching portion 8 may not be installed in some cases. When the tension applying mechanism 5 and the roll attaching portion 8 are not installed, as shown in FIG. 8, the roll attaching portion 7 may be installed on an upper side in a state where the tension applying mechanism 5 and the roll attaching portion 8 are installed.

The roll attaching portions 10, and 11 are disposed on the front side of the supporting frames 18. That is, the medium 2 after printing is wound into a roll shape on the front side of the supporting frames 18. The roll attaching portion 10 is configured similarly to the roll attaching portion 7 and includes two shaft supporting portions 40 that support both ends of an elongated cylindrical winding shaft around which the roll 2D is wound. The shaft support portions 40 are held by a guide shaft 41 so as to be movable in the front-back direction. The shaft supporting portions 40 each are movable in the front-back direction along the guide shaft 41. Furthermore, the shaft supporting portions 40 each are connected to a drive mechanism that rotates the shaft supporting portion 40.

The roll attaching portion 11 is configured similarly to the roll attaching portion 8 and includes a rotating shaft 42 inserted to an elongate cylindrical winding shaft around which the roll 2E is wound. The rotating shaft 42 is disposed so that an axial direction of the rotating shaft 42 and the left-right direction coincide. A right end of the rotating shaft 42 is rotatably supported by the frame 24 disposed on the right end side of the tension applying mechanism 6, and a left end of the rotating shaft 42 is rotatably supported by the frame 24 disposed on the left end side of the tension applying mechanism 6. Flange members 43 disposed on both sides of the roll 2E in the left-right direction are fixed to both ends of the rotating shaft 42. The rotating shaft 42 is connected to a drive mechanism that rotates the rotating shaft 42.

The roll attaching portions 10, and 11 are disposed on a back side with respect to the tension bar 23 of the tension applying mechanism 6. That is, the roll attaching portions 10, and 11 are disposed at positions closer to the supporting frames 18 than the tension bar 23 of the tension applying mechanism 6. Furthermore, the roll attaching portion 10 is disposed on a lower side of the roll attaching portion 11. Moreover, the roll attaching portion 10 is disposed on the back side of the tension bar 23 of the tension applying mechanism 6.

(Usage Modes of Printer)

FIGS. 4 to 8 are side views for explaining usage modes of the printer 1 shown in FIG. 1.

Figure 4:
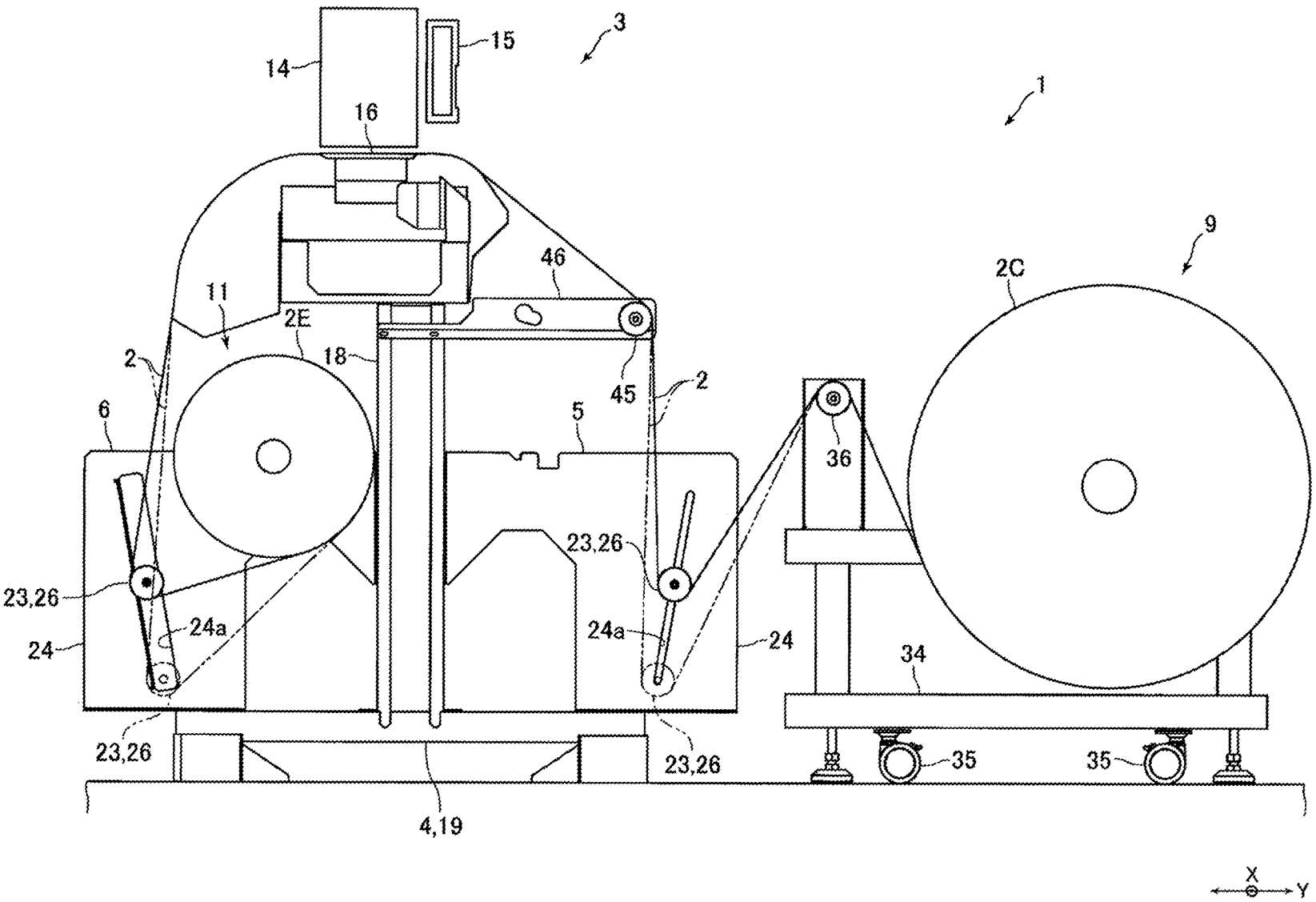
FIG. 4 is a side view for explaining a usage mode of the printer shown in FIG. 1.
Figure 5:
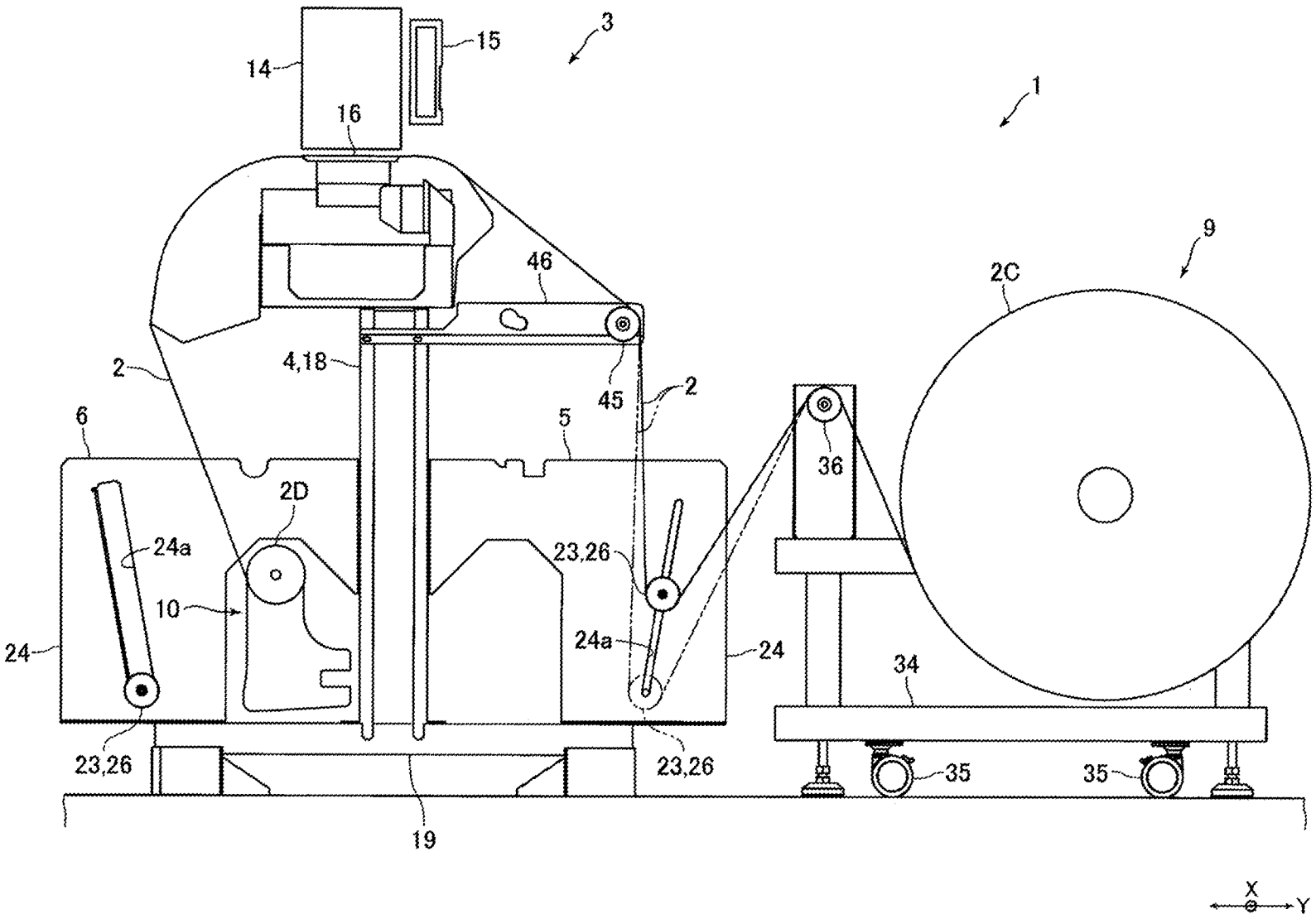
FIG. 5 is a side view for explaining a usage mode of the printer shown in FIG. 1.
Figure 6:
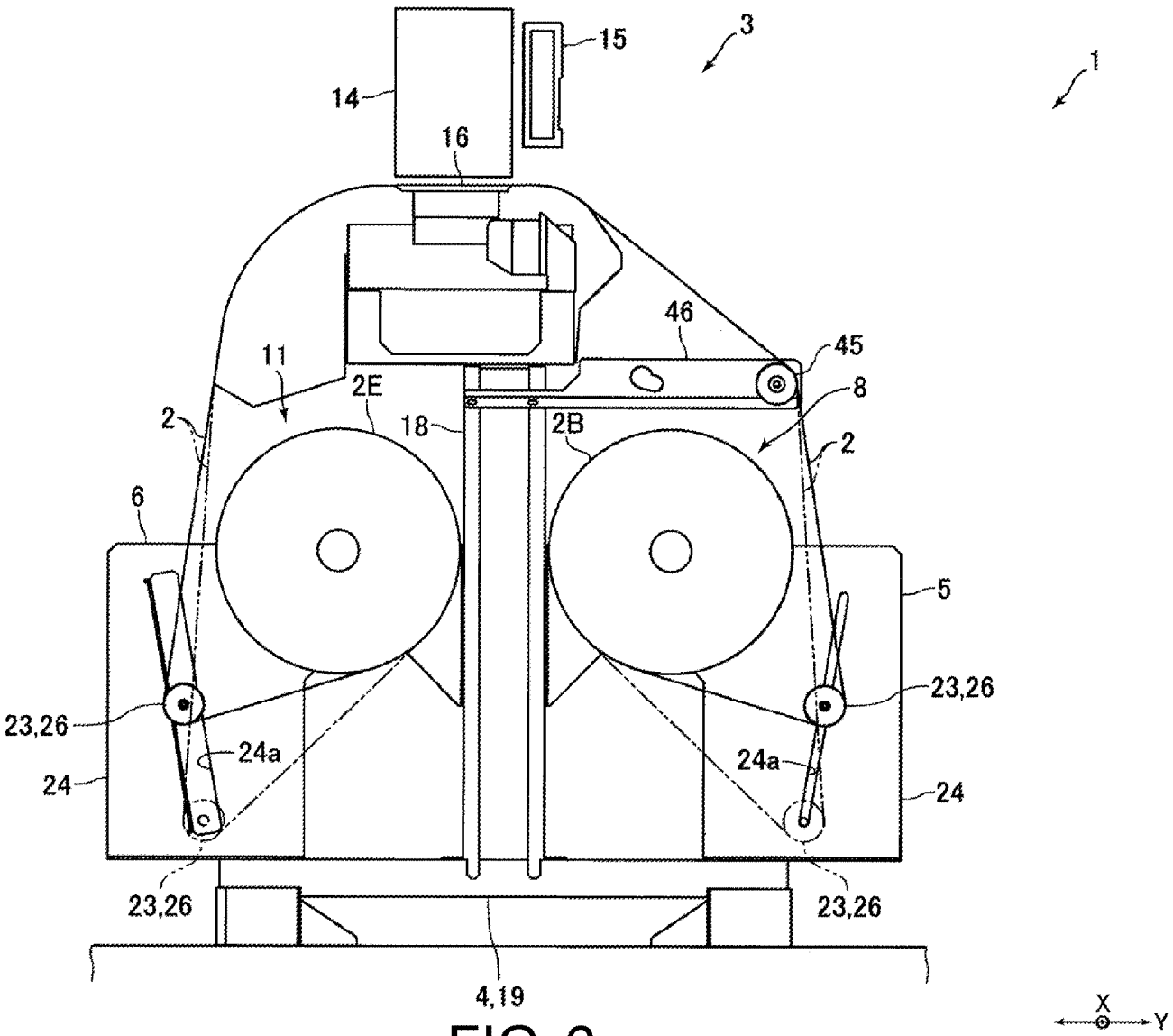
FIG. 6 is a side view for explaining a usage mode of the printer shown in FIG. 1.
Figure 7:
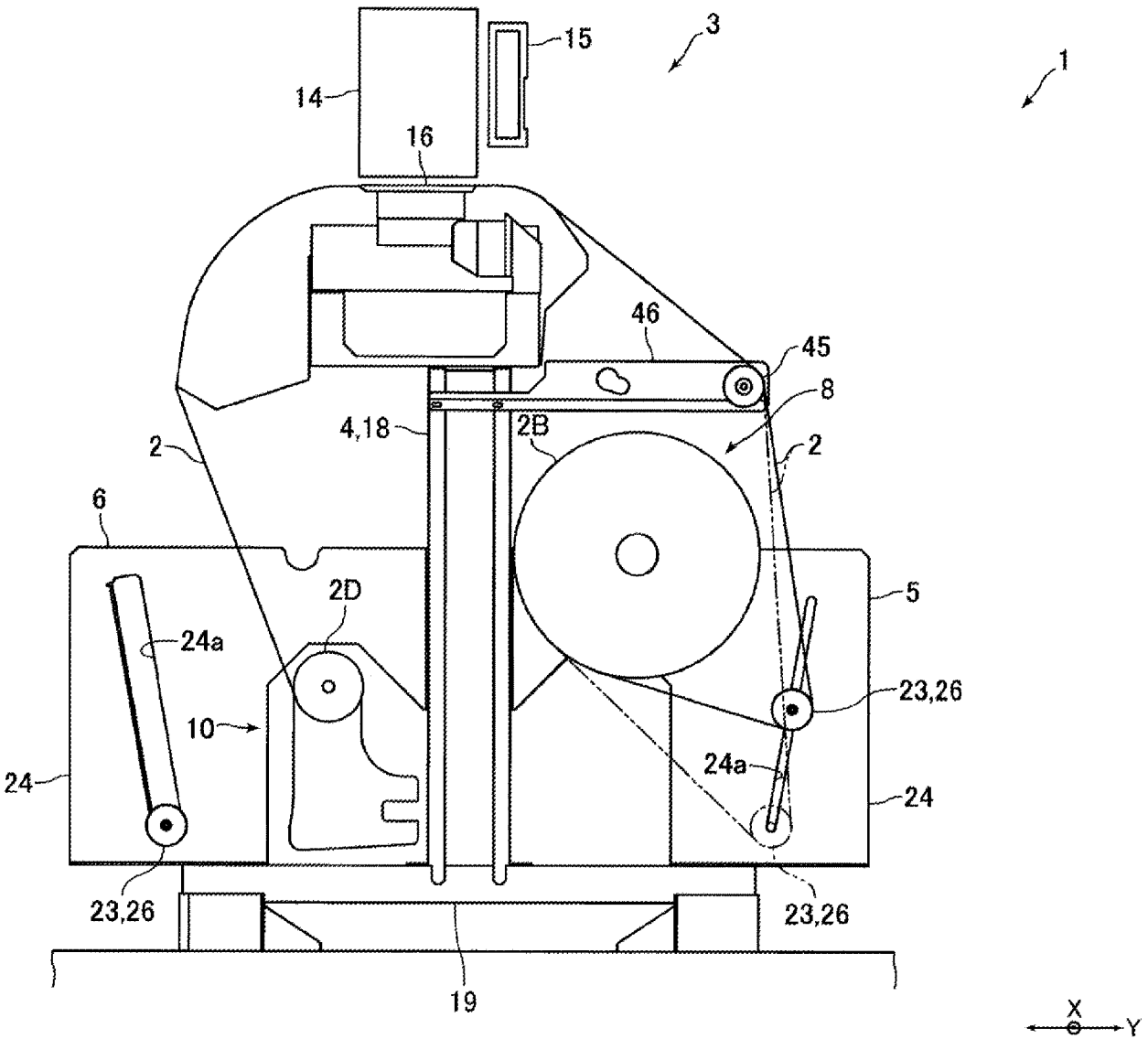
FIG. 7 is a side view for explaining a usage mode of the printer shown in FIG. 1.

As described above, in the printer 1, the medium 2 before printing is attached to one of the roll attaching portions 7 to 9, and the medium 2 after printing is wound by the roll attaching portion 10 or the roll attaching portion 11. For example, in the printer 1, as shown in FIG. 4, the medium 2 before printing is attached to the roll attaching portion 9 and the medium 2 after printing is wound in the roll attaching portion 11, as shown in FIG. 5, the medium 2 before printing is attached to the roll attaching portion 9 and the medium 2 after printing is wound in the roll attaching portion 10, as shown in FIG. 6, the medium 2 before printing is attached to the roll attaching portion 8 and the medium 2 after printing is wound in the roll attaching portion 11, as shown in FIG. 7, the medium 2 before printing is attached to the roll attaching portion 8 and the medium 2 after printing is wound in the roll attaching portion 10, and as shown in FIG. 8, the medium 2 before printing is attached to the roll attaching portion 7 and the medium 2 after printing is wound in the roll attaching portion 10.

When the medium 2 before printing is attached to the roll attaching portions 8, and 9, the tension applying mechanism 5 is used. The tension bar 23 of the tension applying mechanism 5 is in contact with the upper surface side of the medium 2. When the medium 2 before printing is attached to the roll attaching portion 8, the medium 2 passes through a lower side of the tension bar 23 of the tension applying mechanism 5 toward the back side and is then transported toward the upper side. When the medium 2 before printing is attached to the roll attaching portion 9, the medium 2 passes through the lower side of the tension bar 23 of the tension applying mechanism 5 toward the front side and is then transported toward the upper side.

Furthermore, when the medium 2 before printing is attached to the roll attaching portions 8, and 9, a guide roller 45 for guiding the medium 2 is disposed on the upper side of the tension applying mechanism 5. The guide roller 45 is turnably attached to supporting members 46. The supporting members 46 each are fixed to the upper end side of each of the supporting frames 18. The guide roller 45 is disposed on the back side with respect to the printer main body 3. Furthermore, the guide roller 45 is in contact with the front surface side of the medium 2.

On the other hand, when the medium 2 before printing is attached to the roll attaching portion 7, the tension applying mechanism 5 and the guide roller 45 are not used. In this case, as shown in FIG. 8, the tension applying mechanism 5, the guide roller 45, and the supporting frames 46 may be detached from the supporting body 4 in some cases. However, when the medium 2 before printing is attached to the roll attaching portion 7, the tension applying mechanism 5 may be attached to the supporting body 4. In this case, as indicated by a chain double dashed line in FIG. 1, the roll attaching portion 7 is disposed on a lower side of the roll attaching portion 8. Furthermore, when the medium 2 before printing is attached to the roll attaching portion 7, the guide roller 45 and the supporting frame 46 may be attached to the supporting body 4.

Furthermore, when the medium 2 after printing is wound in the roll attaching portion 11, the tension applying mechanism 6 is used. The tension bar 23 of the tension applying mechanism 6 is in contact with the upper surface side of the medium 2. The medium 2 passes through the lower side of the tension bar 23 of the tension applying mechanism 6 toward the back side. On the other hand, when the medium 2 after printing is wound in the roll attaching portion 10, the tension applying mechanism 6 is not used. In this case, as shown in FIG. 8, the tension applying mechanism 6 may be detached from the supporting body 4 in some cases.

In this embodiment, as shown in FIG. 8, the configuration of the printer 1 in a state where the medium 2 before printing is attached to the roll attaching portion 7, the medium 2 after printing is wound in the roll attaching portion 10, and the tension applying mechanisms 5, and 6, the roll attaching portions 8, 9, and 11, the guide roller 45, and the supporting frames 46 are detached from the supporting body 4, is set as a standard configuration of the printer 1, and the tensioning applying mechanisms 5, and 6, the roll attaching portion 8, 9, and 11, the guide roller 45, and the supporting frames 46 can be optionally used. In this case, the medium 2 before printing can be fed from the rolls 2B, 2C having a larger outer diameter, and the medium 2 after printing can be wound around the roll 2E having a larger outer diameter by installing options with respect to the standard configuration of the printer 1.

(Main Effect of the Present Embodiment)

As described above, in the present embodiment, the roll attaching portion 8, the tension bar 23 of the tension applying mechanism 5, and the roll attaching portion 9 are disposed on the back side of the supporting frames 18 and are disposed in this order from the supporting frame 18 side in the front-back direction, where the roll attaching portion 9 is disposed at a position away from the supporting frames 18. Specifically, the roll attaching portion 9 is disposed on the back side with respect to the supporting members 19 of the supporting body 4. Therefore, in the present embodiment, a distance between the medium 2 after printing (i.e., roll 2D or roll 2E) wound into a roll shape on the front side of the supporting frames 18 and the roll 2C attached to the roll attaching portion 9 can be separated. Therefore, in the present embodiment, the maximum outer diameter of the roll 2C attached to the roll attaching portion 9 can be set without being subjected to a restriction of an outer diameter of the roll 2D or the roll 2E.

Furthermore, in the present embodiment, since the roll attaching portion 9 is disposed on the back side of the printer main body 3, the maximum outer diameter of the roll 2C can be set without being subjected to a restriction of the printer main body 3. Further, in the present embodiment, since the roll attaching portion 9 is disposed at a position distant from the supporting frames 18, the maximum outer diameter of the roll 2C can be set without being subjected to a restriction of the connecting frame 20 connecting the two supporting frames 18.

In the present embodiment, the tension applying mechanism 5 includes the frames 24 each having the guide groove 24*a* for guiding the tension bar 23 in the vertical direction, and the tension bar 23 moves in the vertical direction along the guide grooves 24*a*. Therefore, in the present embodiment, the tension applied to the medium 2 by the tension bar 23 is unlikely to change according to the vertical position of the tension bar 23. Therefore, in the present embodiment, even if the guide grooves 24*a* are disposed so that a degree of freedom of arrangement of other members does not lower, an appropriate tension can be applied to the medium 2 fed out from the roll 2B attached to the roll attaching portion 8 and the medium 2 fed out from the roll 2C attached to the roll attaching portion 9. That is, in the present embodiment, even if an appropriate tension can be applied to the medium 2 fed out from the roll 2B attached to the roll attaching portion 8 and the medium 2 fed out from the roll 2C attached to the roll attaching portion 9, a degree of freedom of design of the printer 1 can be ensured.

In the feeding side tension applying means of the inkjet printer described in Japanese Unexamined Patent Publication No. 2013-78953, the media arm, to which the tension bar is attached at the distal end, is turnable around the basal end of the media arm, and since the tension bar turns with the basal end of the media arm as a turning center, the tension applied to the medium by the tension bar easily changes according to a turning angle of the media arm with the basal end of the media arm as the turning center. Therefore, in the printer 1 of the present embodiment, when the feeding side tension applying means described in Japanese Unexamined Patent Publication No. 2013-78953 is adopted, unless the turning center of the media arm is disposed at an optimum position, it becomes difficult to apply an appropriate tension to the medium 2 fed out from the roll 2B attached to the roll attaching portion 8 and the medium 2 fed out from the roll 2C attached to the roll attaching portion 9.

On the other hand, in a case where the turning center of the media arm is arranged at the optimum position, the degree of freedom of arrangement of other members lowers. That is, in the printer 1 of the present embodiment, when the feeding side tension applying means described in Japanese Unexamined Patent Publication No. 2013-78953 is adopted, the degree of freedom of design of the printer 1 lowers to apply an appropriate tension to the medium 2 fed out from the roll 2B attached to the roll attaching portion 8 and the medium 2 fed out from the roll 2C attached to the roll attaching portion 9.

In the present embodiment, in the tension applying mechanism 5, each of the guide grooves 24*a* for guiding the tension bar 23 in the vertical direction is inclined so as to be directed toward the front side as it goes towards the lower side. Therefore, in the present embodiment, a worker can easily access the roll attaching portion 7 when setting the roll 2A to the roll attaching portion 7 disposed on the front side of the tension bar 23 of the tension applying mechanism 5, as compared with a case where each of the guide grooves 24*a* is inclined so as to be directed toward the back side as it goes towards the lower side.

Similarly, in the present embodiment, in the tension applying mechanism 6, each of the guide grooves 24*a* for guiding the tension bar 23 in the vertical direction is inclined so as to be directed toward the back side as it goes towards the lower side, and thus the worker can easily access the roll attaching portion 10 when setting the roll 2D to the roll attaching portion 10 disposed on the back side of the tension bar 23 of the tension applying mechanism 6, as compared with a case where each of the guide grooves 24*a* is inclined so as to be directed toward the front side as it goes towards the lower side.

In the present embodiment, the frames 24 are detachably attached to the supporting body 4. Therefore, in the present embodiment, when the printer 1 does not use the tension applying mechanisms 5, and 6, the tension applying mechanisms 5, and 6 can be easily detached from the supporting body 4.

(Other Embodiment)

The above-described embodiment is an example of a preferred embodiment of the present disclosure, but the present disclosure is not limited thereto, and various modifications can be made without changing the gist of the present disclosure.

In the embodiment described above, the guide grooves 24*a* may be inclined away from the supporting frames 18 toward the lower side, or may be parallel to the vertical direction. Furthermore, in the above-described embodiment, the frames 24 may not be detachable to the supporting body 4. Moreover, in the above-described embodiment, the printer 1 may not include the roll attaching portion 7. Furthermore, the printer 1 may not include the roll attaching portion 10 or the roll attaching portion 11.

In the above-described embodiment, the printer 1 may include a second roll attaching portion configured similarly to the roll attaching portion 9 as the roll attaching portion to which the medium 2 after printing wound into a roll shape can be attached. In this case, a maximum outer diameter of the second roll, which is the medium 2 after printing wound into a roll shape and attached to the second roll attaching portion, is larger than the maximum outer diameter of the roll 2E. The tension applying mechanism 6 is used when the medium 2 after printing is wound in the second roll attaching portion.

Furthermore, in this case, the roll attaching portion 11, the tension bar 23 of the tension applying mechanism 6, and the second roll attaching portion are disposed in this order from the back side toward the front side. That is, the roll attaching portion 11, the tension bar 23 of the tension applying mechanism 6, and the second roll attaching portion are disposed on the front side of the supporting frames 18 and disposed in this order from the supporting frames 18 side in the front-back direction, where the second roll attaching portion is disposed at a position farther away from the supporting frames 18 than the tension bar 23 of the tension applying mechanism 6. Furthermore, the second roll attaching portion is disposed on the front side with respect to the printer main body 3 and the supporting members 19. The roll attaching portion 11 in this case is the first roll attaching portion, and the roll 2E is the first roll.

In this case, since the second roll attaching portion is disposed at a position away from the supporting frames 18, the medium 2 before printing (specifically, roll 2A or roll 2B) wound into a roll shape on the back side of the supporting frames 18 and the second roll attached to the second roll attaching portion can be separated. Therefore, a maximum outer diameter of the second roll attached to the second roll attaching portion can be set without being subjected to a restriction of an outer diameter of the roll 2A or the roll 2B. Furthermore, since the second roll attaching portion is disposed on the front side with respect to the printer main body 3, the maximum outer diameter of the second roll can be set without being subjected to the restriction of the printer main body 3. Moreover, since the second roll attaching portion is disposed at a position distant from the supporting frame 18, the maximum outer diameter of the second roll can be set without being subjected to the restriction of the connecting frame 20.

In this case, the tension applying mechanism 6 includes the frames 24 each having the guide groove 24*a* for guiding the tension bar 23 in the vertical direction, and the tension bar 23 moves in the vertical direction along the guide grooves 24*a*, whereby the tension applied to the medium 2 by the tension bar 23 is unlikely to change according to the vertical position of the tension bar 23. Therefore, in this case, as with the above-described embodiment, even if the guide grooves 24*a* are disposed so as not to lower the degree of freedom of arrangement of other members, an appropriate tension can be applied to the medium 2 wound around the roll 2E attached to the roll attaching portion 11 and the medium 2 wound around the second roll attached to the second roll attaching portion. That is, even if an appropriate tension can be applied to the medium 2 wound around the roll 2E attached to the roll attaching portion 11 and the medium 2 wound around the second roll attached to the second roll attaching portion, the degree of freedom of design of the printer 1 can be ensured.

In the printer 1, in a case where the winding side tension applying means described in Japanese Unexamined Patent Publication No. 2013-78953 is adopted, as in the above-described embodiment, it becomes difficult to apply an appropriate tension to the medium 2 wound around the roll 2E attached to the roll attaching portion 11 and the medium 2 wound around the second roll attached to the second roll attaching portion unless the turning center of the media arm is disposed at an optimum position, while if the turning center of the media arm is disposed at an optimum position, the degree of freedom of arrangement of other members lowers, and hence the degree of freedom of design of the printer 1 lowers so as to apply an appropriate tension to the medium 2 wound around the roll 2E attached to the roll attaching portion 11 and the medium 2 wound around the second roll attached to the second roll attaching portion.

It will be apparent to those skilled in the art that various modifications and variations can be made to the disclosed embodiments without departing from the scope or spirit of the disclosure. In view of the foregoing, it is intended that the disclosure covers modifications and variations provided that they fall within the scope of the following claims and their equivalents.

What is claimed is:

1. A printer comprising a printer main body that performs printing on a long medium, a supporting frame that supports the printer main body from a lower side, a tension applying mechanism including a tension bar that comes into contact with a medium before printing and applies a tension to the medium, and a first roll attaching portion and a second roll attaching portion to which the medium before printing wound into a roll shape is attachable, wherein the first roll attaching portion, the tension bar, and the second roll attaching portion are disposed on one side of the supporting frame in a first direction, which is one direction in a horizontal direction, and are disposed in such order from the supporting frame side in the first direction;

a medium after printing is wound into the roll shape on another side of the supporting frame in the first direction;

assuming that the medium before printing wound into the roll shape and attached to the first roll attaching portion is a first roll and the medium before printing wound into the roll shape and attached to the second roll attaching portion is a second roll, a maximum outer diameter of the second roll is larger than a maximum outer diameter of the first roll; and the tension applying mechanism includes a frame in which a guide groove having a slit shape for guiding the tension bar in a vertical direction is formed, the medium that is wound up by the first roll and the second roll are both transported to the tension bar from above the tension bar, and then transported above the tension bar after passing underneath the tension bar.

2. A printer comprising a printer main body that performs printing on a long medium, a supporting frame that supports the printer main body from a lower side, a tension applying mechanism including a tension bar that comes into contact with a medium after printing and applies a tension to the medium, and a first roll attaching portion and a second roll attaching portion to which the medium after printing wound into a roll shape is attachable, wherein the first roll attaching portion, the tension bar, and the second roll attaching portion are disposed on one side of the supporting frame in a first direction, which is one direction in a horizontal direction, and are disposed in such order from the supporting frame side in the first direction;

a medium before printing is wound into the roll shape on another side of the supporting frame in the first direction;

assuming that the medium after printing wound into the roll shape and attached to the first roll attaching portion is a first roll and the medium after printing wound into the roll shape and attached to the second roll attaching portion is a second roll, a maximum outer diameter of the second roll is larger than a maximum outer diameter of the first roll; and the tension applying mechanism includes a frame in which a guide groove having a slit shape for guiding the tension bar in a vertical direction is formed, the medium that is wound out by the first roll and the second roll are both transported to the tension bar from above the tension bar, and then transported above the tension bar after passing underneath the tension bar.

3. The printer according to claim 1, wherein the guide groove is inclined so as to approach the supporting frame towards the lower side.

4. The printer according to claim 1, further comprising a supporting body including a supporting member to which a lower end of the supporting frame is fixed, wherein the frame is detachably attached to the supporting body.

5. The printer according to claim 2, wherein the guide groove is inclined so as to approach the supporting frame towards the lower side.

6. The printer according to claim 2, further comprising a supporting body including a supporting member to which a lower end of the supporting frame is fixed, wherein the frame is detachably attached to the supporting body.

7. The printer according to claim 1, wherein a guide roller, for transporting the medium, is disposed between the tension bar and the second roll attaching portion in the first direction, and the guide roller is disposed above the tension bar.

8. The printer according to claim 2, wherein a guide roller, for transporting the medium, is disposed between the tension bar and the second roll attaching portion in the first direction, and the guide roller is disposed above the tension bar.

* * * * *